United States Patent [19]

Komatsu et al.

[11] 4,218,181

[45] Aug. 19, 1980

[54] BARREL TYPE CENTRIFUGAL TURBO-MACHINE

[75] Inventors: Kazuhiro Komatsu; Kunio Kamata; Kenichi Kasai, all of Ibaraki, Japan

[73] Assignee: Hitachi, Ltd., Japan

[21] Appl. No.: 891,626

[22] Filed: Mar. 30, 1978

[30] Foreign Application Priority Data

Nov. 21, 1977 [JP] Japan ..... 52-138973

[51] Int. Cl.[2] ..... F04D 29/44; F01D 25/24; B23P 15/00

[52] U.S. Cl. ..... 415/189; 415/199.1; 415/219 C; 29/156.4 R; 29/446

[58] Field of Search ..... 415/189, 190, 199.1, 415/199.2, 199.3, 219 C, DIG. 3; 29/263, 156.4 R, 446, 453; 269/243

[56] References Cited

U.S. PATENT DOCUMENTS

| | | | |
|---|---|---|---|
| 2,486,683 | 11/1949 | Sass | 269/243 |
| 2,643,852 | 6/1953 | Holzwarth | 415/219 C |
| 3,424,372 | 1/1969 | Blattner et al. | 415/219 C |
| 3,733,145 | 5/1973 | Kaplansky et al. | 415/199.1 |
| 3,942,908 | 3/1976 | Pilarczyk | 415/219 C |
| 4,063,831 | 12/1977 | Meuret | 29/446 |
| 4,124,233 | 11/1978 | Ahlstone | 29/446 |

FOREIGN PATENT DOCUMENTS

| | | | |
|---|---|---|---|
| 2125042 | 11/1972 | Fed. Rep. of Germany | 415/199.1 |
| 829977 | 3/1960 | United Kingdom | 415/199.1 |

*Primary Examiner*—John J. Vrablik
*Attorney, Agent, or Firm*—Craig & Antonelli

[57] ABSTRACT

A barrel type centrifugal turbo-machine having an outer casing and an inner casing assembly fitted into the outer casing, which inner casing assembly includes a rotor shaft and a plurality of stage structures and a head cover provided around the shaft. A pushing member is provided adjacent to an inlet end stage structures, one end wall thereof abutting to this end stage structure and the other end wall thereof being held on the shaft by means of a lock nut, whereby upon tightening this lock nut against the pushing member each of the stage structures and head cover of the inner casing assembly may be fixed each other in a cartridge like form which is ready to be inserted into the outer casing.

7 Claims, 2 Drawing Figures

Figures 1, 2, 3, 4:
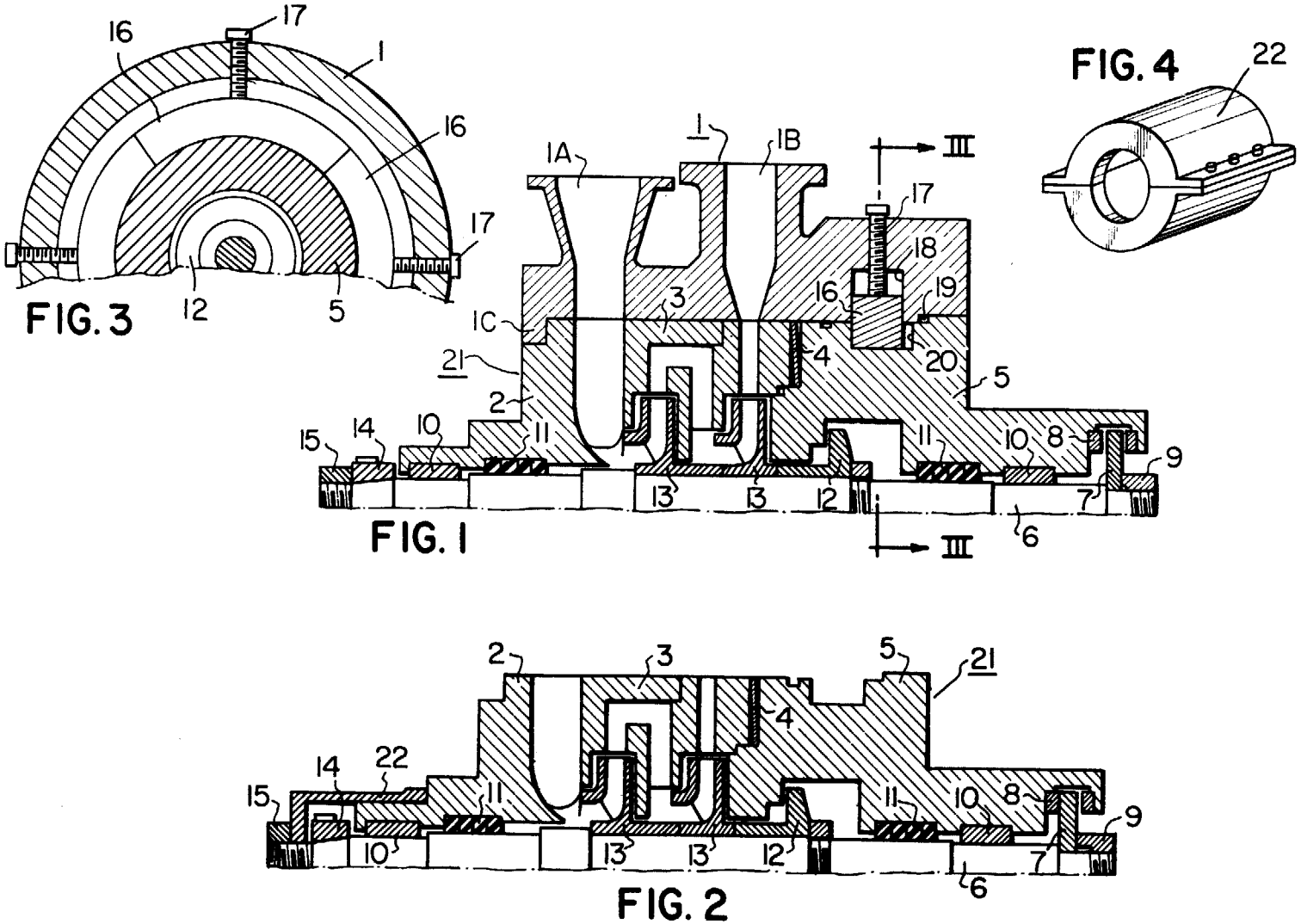

III
III

BARREL TYPE CENTRIFUGAL TURBO-MACHINE

The present invention relates to a barrel type centrifugal turbo-machine having an outer casing and an inner casing assembly fitted into the outer casing, which inner casing assembly includes a rotor shaft and a plurality of non-rotatable stage structures and a head cover provided around the rotor shaft.

According to the prior art, when a barrel type multi-stage centrifugal turbo-machine, such as a pump, a compressor or the like, is to be assembled, the following steps have been employed.

First, a plurality of the stage structures, a head cover and the associated component parts are stacked each other at the outside of the outer casing for temporarily assembling the inner casing assembly. Then, this temporarily assembled inner casing assembly is inserted into the outer casing, say from one end thereof, with an inlet stage structure first, to abut a stepped portion thereof against a shoulder or an abutment of the outer casing, and then an intermediate stage structure is inserted. Thereafter, a head cover is inserted through a cover fixed thereon. These inserted stage structures are tightly fixed by means of studs or bolts till all of the axial gaps are taken up.

When such the turbo-machine is to be disassembled, the above steps have to be reversed.

As seen, the prior art construction requires a considerable time for assemblying and disassemblying. Further, in such the prior art construction, it is very difficult to properly adjust the gaps between the rotary portions and each of the stage structures.

The purpose of the present invention is to provide construction of a barrel type centrifugal turbo-machine which is easily assembled and disassembled, and the inner casing assembly having a rotor shaft and a plurality of non-rotatable stage structures and a head cover provided around the shaft may simply be inserted into the outer casing as it is precisely assembled at the outside of the outer casing.

According to the present invention, there is provided a barrel type centrifugal turbo-machine having an outer casing and an inner casing assembly, in which said inner casing assembly comprises a shaft, a plurality of impellers fixed on said shaft, a plurality of stage structures provided around said impellers, a head cover, and a projecting member provided on said shaft adjacent to one of the end stage structures of said plurality of the stage structures, said inner casing assembly being so arranged that it may be assembled by abutting said stage structures against said projecting member, providing a pushing member with one end wall thereof abutting to the outer end stage structure of said plurality of the stage structures, and with the other end wall of said pushing member being fixed to the shaft by a lock nut, and tightening said lock nut in an axial direction whereby said plurality of the stage structures may be fixed on said shaft through said projecting member so as to permit said inner casing assembly be assembled into said outer casing as said plurality of the stage structures and said head cover are fixed each other.

Other and further objects of the present invention will become apparent to those skilled in the art upon a study of the following description and accompanying drawings, in which:

FIG. 1 is a sectional view showing barrel type centrifugal pump according to the present invention, FIG. 2 is a sectional view of an inner casing assembly of the pump of FIG. 1 for showing a manner of assemblying the same, FIG. 3 is a partial sectional view of the pump of FIG. 1 taken along the line III—III, and FIG. 4 is a perspective view of the circumferentially divided pushing member shown in FIG. 2.

A preferred embodiment of the present invention will now be explained in conjection with the accompanying drawings.

The centrifugal turbo-machine, such as a centrifugal, pump of the present invention has, as shown in FIG. 1, an outer casing 1 having an inlet port 1A and an outlet port 1B, and an inner casing assembly 21 fitted in the outer casing 1.

The inner casing assembly 21 has a rotor shaft 6, two groups of impellers 13 mounted on and rotatable with the shaft 6, two non-rotatable stage structures, namely an inlet stage structure 2 and an intermediate stage structure 3, and a head cover 5 having thrust bearings 8 adapted to engage with a thrust collar 7 to be described. A spring 4 is interposed between the intermediate stage structure 3 and the head cover 5 so as to bias them away from each other.

The shaft 6 is further provided with a thrust collar 7 adjacent to the head cover 5, a lock nut 9 for holding this thrust collar 7, a balance disc 12 projecting inwardly of the head cover 5, a gear coupling 14 outside of the inlet stage structure 2 and a lock nut 15 to hold this gear coupling 14 in place.

There are provided with bearings 10 and seals 11 between the shaft 6 and each of the inlet stage structure 2 and the head cover 5.

The outer casing 1 is formed with, at one end thereof, a shoulder 1C adapted to engage with the outer end of the inlet stage structure 2, and on the inner surface thereof adjacent to the other end a circumferential groove 18 for snugly receiving a shear key 16 which is circumferentially divided into a plurality of pieces as shown in FIG. 3 and held by means of bolts 17. A corresponding circumferential groove 20 having a slightly greater width is also formed on the outer surface of the head cover 5 for receiving the shear key 16. An annular gap 19 for a small axial length is formed between the outer casing 1 and the head cover 5.

The bolts 17 carried by the outer casing 1 extend into the circumferential groove 18 to bias the shear key 16 radially inwardly into the opposing circumferential groove 20 of the head cover 5.

With the above described construction, the shoulder 1C and the shear key 16 prevent a relative axial movement of the outer casing 1 and the inner casing assembly 21, and resist against the axial force developed by the discharge pressure. At the same time, the spring 4 biases the inlet stage structure 2 against the shoulder 1C of the outer casing 1 to form a seal therebetween during a low pressure operation.

Referring now to FIG. 2, a manner of assemblying the inner casing assembly 21 will be explained.

The inner casing assembly 21 is assembled at the outside of the outer casing 1 and the axial and the radial gaps are properly adjusted. Then, a circumferentially divided cylindrical member 22 pushing as shown in FIGS. 2 and 3 is placed between the gear coupling 14 and the lock nut 15, with one end wall thereof abutting against the inlet stage structure 2. Upon tightening this lock nut 15 against the other end wall of the pushing member 22, the inlet stage structure 2, the intermediate stage structure 3 and the head cover 5 are pushed rightwardly in the drawing so that the thrust bearings 8 are forced to the thrust collar 7. The lock nut 15 is further tightened to compress the spring 4 so as to bring the circumferential groove 20 in a position in which the shear key 16 may readily be inserted thereinto. In this condition, the inner casing assembly 21 becomes a complete cartridge. While maintaining this cartridge form, the inner casing assembly 21 is pushed into the outer casing 1 till the outer end of the inlet stage structure 2 abuts against the shoulder 1C of the outer casing 1, and the shear key 16 is inserted into the groove 20 by the bolts 17. After that, the lock nut 15 is loosened so as to permit the spring 4 to push the head cover 5 against the shear key 16, due to the expansion force of the spring 4, whereby an axial movement of the inner casing assembly 21 relative to the outer casing 1 will be prevented. On the other hand, the contacting surface between the shoulder 1C of the outer casing 1 and the outer end of the inlet stage structure 2 develops a surface pressure and thus performs a sealing effect. Thereafter, the lock nut 15 is further loosened, the pushing member 22 is removed, and the lock nut 15 is re-tightened to fix the gear coupling 14 to complete the assemblying operation. In this case, there is found no necessity of adjusting the axial gaps after the pump is completely assembled.

When the thrust bearings 8 are not utilized, the head cover 5 may be abutted against the balance disc 12 so that the rest of the above steps may be employed.

It is needless to say that the pump may be disassembled by performing the aforementioned steps in a reverse order.

According to the present invention, as explained above, it is possible to assemble the inner casing assembly into a cartridge like form, and be inserted into the outer casing with all of the parts precisely centered. The present invention also enables assembling and disassembling operations in a short time and in an efficient manner.

What is claimed is:

1. A barrel-type centrifugal turbo-machine comprising an outer casing and an inner casing assembly fitted in said outer casing, said inner casing assembly comprising a rotary shaft, a plurality of impellers fixed on said rotary shaft, a plurality of stage structures provided around said plurality of impellers, a head cover attached to one end stage structure of said plurality of stage structures, and a resilient means mounted in an axial gap between said one end stage structure and said head cover, wherein said turbo-machine further comprises a projecting member mounted on said rotary shaft and located at an axial end of said head cover to extend radially outwardly of said rotary shaft, a pushing member located opposite said projecting member axially of said rotary shaft and adjacent the other end structure of said plurality of stage structures, said pushing member abutting at one end wall thereof against said the other end stage structure and being fixed at the other end wall thereof to said rotary shaft by a lock nut, a shear key inserting circumferential groove formed on the inner circumferential surface of said outer casing against which said inner casing assembly is clamped, a shear key receiving annular groove formed on the outer circumferential surface of said head cover, said shear key receiving annular groove being larger in width than said shear key inserting circumferential groove by an amount corresponding to at least the width of said axial gap mounting said resilient means therein so that said former groove extends a larger distance than said latter groove axially of the rotary shaft along the inner circumferential surface of said outer casing against which said inner casing assembly is clamped, a shear key positioned in said grooves, said shear key being movable vertically between said shear key inserting circumferential groove and said shear key receiving annular groove, means being provided on said outer casing for effecting movement of said shear key into said shear key receiving annular groove, a radially inwardly projecting shoulder formed at one end of the inner circumferential surface of the outer casing against which said inner casing assembly is clamped, and a cutout complementary with said shoulder formed at one end of the outer circumferential surface of the inner casing assembly at which the inner casing assembly is clamped against the outer casing, whereby the assembly of said turbo-machine is facilitated in that said resilient means interposed between said one end stage structure and said head cover can be axially compressed to form the inner casing assembly into a unitary structure as said lock nut is tightened to clamp the inner casing assembly axially of said rotary shaft through said pushing member, the unitary structure can be fitted into said outer casing in such a manner that said shoulder is brought into engagement with said cutout, and the reafter the inner casing assembly can be fixed to said outer casing by moving said shear key from said shear key inserting circumferential groove into said shear key receiving annular groove after which said lock nut is loosened.

2. A barrel type centrifugal turbo-machine according to claim 1, said projecting member being of a thrust collar fixed on said shaft.

3. A barrel type centrifugal turbo-machine according to claim 1, said projecting member being of a balance disc fixed on said shaft.

4. A barrel type centrifugal turbo-machine according to claim 1, said pushing member being of a cylindrical form.

5. A barrel type centrifugal turbo-machine according to claim 4, said pushing member being circumferentially divided into a plurality of pieces for an easy attachment.

6. A barrel type centrifugal turbo-machine according to claim 1, wherein said shear key is circumferentially divided into a plurality of pieces.

7. A barrel type centrifugal turbo-machine according to claim 6, wherein said means on said outer casing for effecting movement of said shear key into said shear key receiving annular groove comprises a plurality of bolts mounted on and penetrating the outer circumferential surface of said outer casing.

* * * * *